United States Patent [19]

Harayama

[11] Patent Number: 4,567,321

[45] Date of Patent: Jan. 28, 1986

[54] FLEXIBLE FLAT CABLE

[75] Inventor: Chiharu Harayama, Atugi, Japan

[73] Assignee: Junkosha Co., Ltd., Tokyo, Japan

[21] Appl. No.: 653,762

[22] Filed: Sep. 24, 1984

[30] Foreign Application Priority Data

Feb. 20, 1984 [JP] Japan ..... 59-23347

[51] Int. Cl.[4] ..... H01B 7/04; H01B 7/08

[52] U.S. Cl. ..... 174/117 F; 174/113 C; 174/131 A

[58] Field of Search ..... 174/113 C, 117 F, 131 A, 174/110 FC, 110 N, 128 R

[56] References Cited

U.S. PATENT DOCUMENTS

| | | | |
|---|---|---|---|
| 2,998,840 | 9/1961 | Davis | 174/130 |
| 3,234,722 | 2/1966 | Gilmore | 174/128 R |
| 3,760,319 | 9/1973 | Kawazoe | 174/113 C X |
| 4,218,581 | 8/1980 | Suzuki | 174/117 F |
| 4,313,645 | 2/1982 | Cocco | 174/117 F X |
| 4,423,282 | 12/1983 | Suzuki et al. | 174/117 F X |
| 4,443,657 | 4/1984 | Hill et al. | 174/117 F X |

FOREIGN PATENT DOCUMENTS

| | | | |
|---|---|---|---|
| 1107405 | 3/1968 | United Kingdom | 174/110 FC |

OTHER PUBLICATIONS

Fibrous Porous TFE Provides Dimensional Stability for High Temperature, Low Loss Coaxial Cable; Insulations/Circuits; Jun. 1971; p. 19.

Totsuka, M. et al.; The Small Size Telephone Set Cord; Review of the Electrical Communication Laboratories; vol. 22, Nos. 3-4; Mar.-Apr. 1974; Nippon Telegraph and Telephone Public Corp.

*Primary Examiner*—A. T. Grimley
*Assistant Examiner*—Morris H. Nimmo
*Attorney, Agent, or Firm*—Mortenson & Uebler

[57] ABSTRACT

An improved, highly flexible flat multi-conductor electrical cable is provided, useful for example in robots wherein such cables may be flexed many times, comprising a plurality of conductor assemblies held in parallel relationship between layers of insulating coverings, the improvement comprising conductor assemblies having an elongate, non-conductive center core filament helically overwrapped along its longitudinal dimension by a first conductor in foil or tape form, such as copper foil, this first tape conductor having an outer covering of a conductive, low-friction material, the conductive covering being helically overwrapped along its longitudinal dimension by a second conductor in foil or tape form, such as copper foil, the second foil conductor being wrapped in a lay opposite to that of the first conductor, i.e. if one foil conductor is "S" wrapped, the other foil conductor is "Z" wrapped. A preferred core filament material is expanded, porous, sintered polytetrafluoroethylene, and a preferred conductive covering is conductive, unsintered polytetrafluoroethylene. Preferred insulating coverings are layers of polytetrafluoroethylene.

8 Claims, 4 Drawing Figures

(PRIOR CABLE)

FLEXIBLE FLAT CABLE

BACKGROUND OF THE INVENTION

The device relates to improvement in flexible, flat, multi-conductor electrical cables. As a flexible flat cable of this type, a cable such as shown in FIG. 1 has been suggested and is disclosed in Japanese Patent Application JUA-sho 58-143,540. As shown in FIG. 1, flat cable 1 is prepared by arranging in parallel a plurality of flexible conductor assemblies 4 made by winding a conductor 3 such as copper foil around a flexible filamentary body 2 helically in one direction, and laminating the flexible conductor assemblies 4 between resinous layers to fix them and provide insulating covering layers.

In flat cables of this type, a conductor 3 is helically wound around flexible filamentary body 2 in one direction. Therefore, that flat cable was difficult to manufacture because the flexible conductor assemblies 4 bent or wound. The finished flat cables had occurrences of breaking due to formation of looseness or strains and application of excessive reaction to a specific flexible conductor. To eliminate such defects, it is suggested according to this invention to form two conductor layers which differ from each other in the directions of winding about the periphery of the flexible filamentary core. Flat cables made in accordance with this suggestion are improved in looseness, and they tend to have a somewhat shorter bending life and be somewhat less flexible than the cables shown in FIG. 1.

Therefore, the object of the invention is to provide highly flexible flat cables having substantially eliminated the above-mentioned defects, having substantially no cable looseness and having excellent bending life and excellent flexibility.

SUMMARY OF THE INVENTION

An improved, highly flexible multi-conductor electrical cable is provided comprising a plurality of conductor assemblies held in parallel relationship between layers of insulating coverings, the improvement comprising conductor assemblies having an elongate, non-conductive center core filament helically overwrapped along its longitudinal dimension by a first conductor in foil or tape form, this first tape conductor having an outer covering of a conductive, low-friction material, the conductor covering being helically over-wrapped along its longitudinal dimension by a second conductor in foil or tape form, the second foil conductor being wrapped having a lay opposite to that of the first conductor. The foil conductors are preferably copper foils, the core filament is preferably a filament selected from the class consisting of nylon fiber or polytetrafluoroethylene filament, and most preferred is a core filament of expanded, porous sintered polytetrafluoroethylene. The conductive covering is preferably a covering of conductive polytetrafluoroethylene and the insulating coverings are preferably layers of polytetrafluoroethylene.

Figure 1:
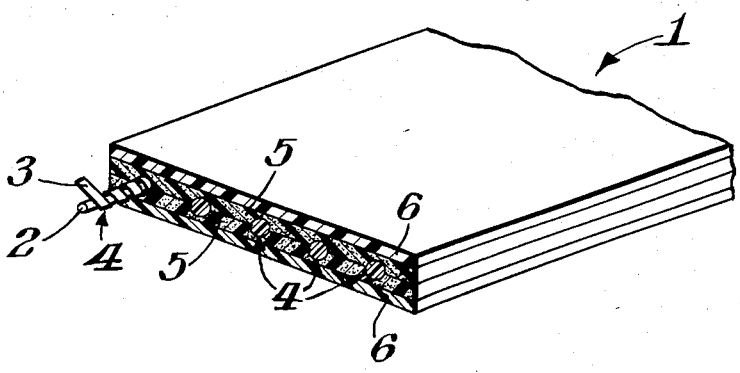
FIG. 1 is a pictorial perspective view of the terminal part of previous flat cables.

DETAILED DESCRIPTION OF THE INVENTION AND PREFERRED EMBODIMENTS WITH REFERENCE TO THE DRAWINGS

An improved, highly flexible flat multi-conductor electrical cable is provided, useful for example in robots wherein such cables may be flexed many times, comprising a plurality of conductor assemblies held in parallel relationship between layers of insulating coverings, the improvement comprising conductor assemblies having an elongate, non-conductive center core filament helically overwrapped along its longitudinal dimension by a first conductor in foil or tape form, such as copper foil, this first tape conductor haing an outer covering of a conductive, low-friction material, the conductive covering being helically overwrapped along its longitudinal dimension by a second conductor in foil or tape form, such as copper foil, the second foil conductor being wrapped in a lay opposite to that of the first conductor, i.e. if one foil conductor is "S" wrapped, the other foil conductor is "Z" wrapped. A preferred core filament material is expanded, porous, sintered polytetrafluoroethylene, and a preferred conductive covering is conductive, unsintered polytetrafluoroethylene. Preferred insulating coverings are layers of polytetrafluoroethylene.

According to the device of this invention, a flat cable is prepared by arranging a plurality of conductor assemblies in parallel, each assembly made by winding two foil conductor layers, differing from each other in the winding direction, around a flexible filamentary core, and encapsulating a plurality of the arranged conductors within insulating covering layers to fix them, and disposing a conductive, low-friction layer between the two foil conductor layers of the conductor assemblies. According to the construction of the conductor assemblies, a conductive low-friction layer is formed between the two foil conductor layers wound in different directions on to the surface of the filamentary body, so that the conductor layers do not contact each other and do not cause substantial friction between them. Therefore, the conductor layers are not damaged by mutual friction in the bending process, so that they do not shorten the bending life of such flat cables substantially. As the conductor layers slide with respect to each other via the mechanism of the conductive low-friction layer between them, they do not reduce the flexibility of such flat cables substantially. In addition, according to the invention, in connecting the flexible conductor assemblies in terminal connection parts by either a pressure connection method, a contact connection method or the like, the conductive low-friction layer acts as a compressed conductor for filling the gap between the foil conductor layers, so that it reduces contact resistance at the connection part and this is advantageous.

When unsintered, partly sintered or sintered, conductive, low-friction polytetrafluoroethylene (PTFE) layer is used, obtained by filling with a conductive material such as carbon black, by surface-treating, or by impregnating, in the flexible conductor assemblies in the construction of this device, the conductive low-friction layer not only has excellent low-friction properties but also has excellent chemical and physical properties and mechanical stability, so that it provides stable performance and long life for such flat cables.

When an expanded, sintered, porous PTFE is used as the flexible filamentary core body of the flexible conductor assemblies, the flexible filamentary body has sufficient flexibility, sufficient mechanical strength and thermal and chemical stability, and that is advantageous. Similarly, when PTFE is used as the insulating covering, stable flat cable products are obtained.

The device will be described in more detail by reference to the drawings.

As stated, FIG. 1 shows prior cable.

Figure 2:
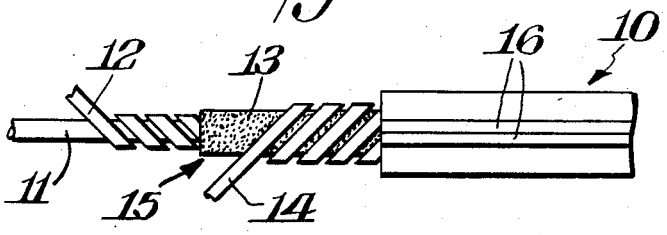
FIG. 2 is a diagrammatical side elevation of the terminal part of a flat cable made according to the invention.

FIG. 2 is a diagrammatical side view of the terminal part of flat cable 10 of the invention. The flat cable 10 is prepared by arranging a plurality of flexible conductor assemblies 15 by lamination between insulating coverings 16, the flexible conductor assemblies 15 being made by winding a conductor 12, such as copper foil, around flexible filamentary body 11, which can be made of nylon fiber, polyamide resin such as Kebura (trademark), or porous, expanded, sintered PTFE having sufficient thermal and chemical stability and sufficient mechanical strength in one direction, applying conductive, low-friction layer 13 around the periphery of conductor 12, and further winding conductor 14 around the periphery of layer 13 in a winding direction different from that of conductor 12. An unsintered, conductive PTFE layer is preferably used as the conductive, low-friction layer 13, and a nonporous, sintered PTFE layer is preferably used as the insulating covering layers 16.

Figure 3:
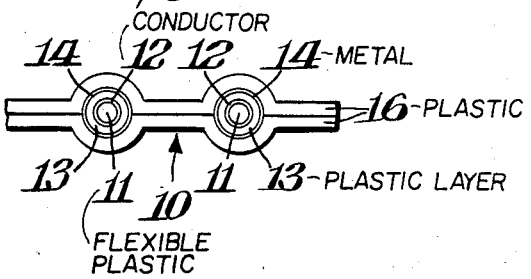
FIG. 3 is a partial view, in end elevation, of the terminal part of the cable shown in FIG. 2.
Figure 4:
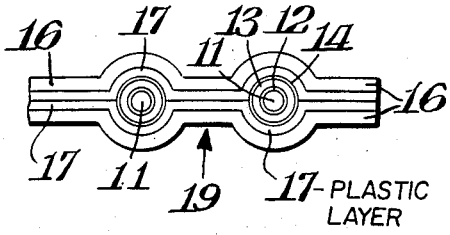
FIG. 4 is a partial view, in end elevation, of the terminal part of an alternate embodiment of the cable of this invention.

A partial terminal part of the thus-obtained flat cable 10 of FIG. 2 is shown in FIG. 3. The flexible conductor assemblies 15 are directly fixed between insulating coverings 16 in this case. As shown in FIG. 4, when a conductive or non-conductive low-friction layer 17, such as an unsintered or partially sintered PTFE layer is installed between the flexible conductor assemblies 15 and the insulating coverings 16, the flexibility of the flat cable is improved so that the layer 17 can be advantageous.

According to the invention, as mentioned above, when a flat cable is prepared by arranging in parallel a plurality of flexible conductor assemblies made by winding a first foil conductor on to the periphery of a flexible filamentary core body in one winding direction, applying a conductive, low-friction layer to the periphery of the first conductor, and winding a second foil conductor around the periphery of the conductive low-friction layer in a winding direction different from that of the first conductor, and then, by fixing a plurality of the flexible conductor assemblies between insulating coverings, the resulting flat cable is substantially free from strains and looseness and it can have extended bending life, increased flexibility and reduced contact resistance at its terminal connections, resulting in improved practicality.

The device is not limited to the above-mentioned examples, and it can be altered in various ways within the scope of thought of the device. For example, in winding a plurality of separated pairs of foil conductors on to a flexible filamentary core, the insulating coverings can be applied directly by extrusion.

While the invention has been disclosed herein in connection with certain embodiments and detailed descriptions, it will be clear to one skilled in the art that modifications or variations of such details can be made without deviating from the gist of this invenion, and such modifications or variations are considered to be within the scope of the claims hereinbelow.

What is claimed is:

1. An improved, highly flexible flat multi-conductor electrical cable comprising a plurality of conductor assemblies held in parallel relationship between layers of insulating coverings, the improvement comprising conductor assemblies having an elongate, non-conductive center core filament helically overwrapped along its longitudinal dimension by a first conductor in foil or tape form, this first tape conductor having an outer covering of a conductive, low friction material, said conductor covering being helically overwrapped along its longitudinal dimension by a second conductor in foil or tape form, said second foil conductor being wrapped having a lay different from that of said first conductor.

2. The cable of claim 1 wherein said second conductor has a lay opposite to that of said first conductor.

3. The cable of claim 1 wherein said foil conductors are copper foils.

4. The cable of claim 1 wherein said core filament is a filament selected from the class consisting of nylon fiber or polytetrafluoroethylene filament.

5. The cable of claim 1 wherein said core filament is expanded, porous, sintered polytetrafluoroethylene filament.

6. The cable of claim 1 wherein said conductive covering is a covering of conductive polytetrafluoroethylene.

7. The cable of claim 6 wherein said polytetrafluoroethylene is unsintered.

8. The cable of claim 1 wherein said insulating coverings are layers of polytetrafluoroethylene.

* * * * *